US005451919A

United States Patent [19]

Chu et al.

[11] Patent Number: 5,451,919

[45] Date of Patent: Sep. 19, 1995

[54] ELECTRICAL DEVICE COMPRISING A CONDUCTIVE POLYMER COMPOSITION

[75] Inventors: Edward F. Chu, Sunnyvale; Ann Banich, Menlo Park; Robert Ives, Newark; Steven Sunshine, San Carlos, all of Calif.; Chi-Ming Chan, Kowloon, Hong Kong

[73] Assignee: Raychem Corporation, Menlo Park, Calif.

[21] Appl. No.: 85,859

[22] Filed: Jun. 29, 1993

[51] Int. Cl.[6] ..... H21C 7/10

[52] U.S. Cl. ..... 338/22 R; 338/22 SD; 252/511

[58] Field of Search ..... 338/22 R, 22 SD; 252/502, 511, 512

[56] References Cited

U.S. PATENT DOCUMENTS

| | | | |
|---|---|---|---|
| 4,237,441 | 12/1980 | van Konynenburg et al. | 338/22 R |
| 4,238,812 | 12/1980 | Middleman et al. | 361/106 |
| 4,255,698 | 3/1981 | Simon | 320/35 |
| 4,272,471 | 6/1981 | Walker | 264/104 |
| 4,286,376 | 9/1981 | Smith-Johannsen et al. | 29/611 |
| 4,315,237 | 2/1982 | Middleman et al. | 338/22 R |
| 4,317,027 | 2/1982 | Middleman et al. | 219/553 |
| 4,330,703 | 5/1982 | Horsma et al. | 219/553 |
| 4,388,607 | 6/1983 | Toy et al. | 338/22 SD |
| 4,426,633 | 1/1984 | Taylor | 338/25 |
| 4,475,138 | 10/1984 | Middleman et al. | 361/58 |
| 4,534,889 | 8/1985 | van Konynenburg et al. | 252/511 |
| 4,545,926 | 10/1985 | Fouts et al. | 252/511 |
| 4,560,498 | 12/1985 | Horsma et al. | 252/511 |
| 4,591,700 | 5/1986 | Sopory | 219/505 |
| 4,624,990 | 11/1986 | Lunk et al. | 338/22 R X |
| 4,689,475 | 8/1987 | Matthiesen | 219/553 |
| 4,724,417 | 2/1988 | Au et al. | 338/22 R |
| 4,774,024 | 9/1988 | Deep et al. | 252/511 |
| 4,780,598 | 10/1988 | Fahey et al. | 219/511 |
| 4,800,253 | 1/1989 | Kleiner et al. | 219/553 |
| 4,845,838 | 7/1989 | Jacobs et al. | 29/671 |
| 4,859,836 | 8/1989 | Lunk et al. | 219/548 |
| 4,907,340 | 3/1990 | Fang et al. | 29/610.1 |
| 4,924,074 | 5/1990 | Fang et al. | 219/548 |
| 4,935,156 | 6/1990 | van Konynenburg et al. | 219/553 |
| 5,000,875 | 3/1991 | Kolouch | 252/511 |
| 5,041,500 | 8/1991 | Ishiwari et al. | 525/200 |
| 5,049,850 | 9/1991 | Evans et al. | 338/22 R |
| 5,057,345 | 10/1991 | Barrett | 428/35.1 |
| 5,089,801 | 2/1992 | Chan et al. | 338/22 R |
| 5,093,898 | 3/1992 | van Konynenburg et al. | 392/451 |
| 5,250,226 | 10/1993 | Oswal et al. | 252/500 |
| 5,250,228 | 10/1993 | Baigrie et al. | 252/511 |
| 5,317,061 | 5/1994 | Chu et al. | 525/200 |

FOREIGN PATENT DOCUMENTS

| | | | |
|---|---|---|---|
| 362868 | 4/1990 | European Pat. Off. | C08L 27/18 |
| 2603132 | 2/1988 | France | H01C 7/02 |
| WO89/12308 | 12/1989 | WIPO | H01C 7/02 |

OTHER PUBLICATIONS

International Search Report, PCT/US94/07175, filed Jun. 27, 1994.

*Primary Examiner*—Marvin M. Lateef

*Attorney, Agent, or Firm*—Marguerite E. Gerstner; Herbert G. Burkard

[57] ABSTRACT

A conductive polymer composition which has a resistivity of less than 10 ohm-cm and which exhibits PTC behavior comprises a polymeric component and a particulate conductive filler. The polymeric component comprises a first crystalline fluorinated polymer having a first melting point $T_{m1}$ and a second crystalline fluorinated polymer having a second melting point $T_{m2}$ which is from $(T_{m1}+25)°$ C. to $(T_{m1}+100)°$ C. The composition exhibits one of a number of characteristics, including a relatively high PTC anomaly. The composition is useful in circuit protection devices to be used at high ambient conditions.

16 Claims, No Drawings

ELECTRICAL DEVICE COMPRISING A CONDUCTIVE POLYMER COMPOSITION

BACKGROUND OF THE INVENTION

1. Field of the Invention

This invention relates to conductive polymer compositions and electrical devices comprising such compositions.

2. Introduction to the Invention

Conductive polymers and electrical devices comprising them are well-known. Conventional conductive polymer compositions comprise an organic polymer, often a crystalline organic polymer, and, dispersed in the polymer, a particulate conductive filler such as carbon black or metal particles. Reference may be made, for example, to U.S. Pat. Nos. 4,237,441 (van Konynenburg et al), 4,388,607 (Toy et al), 4,534,889 (van Konynenburg et al), 4,545,926 (Fouts et al), 4,560,498 (Horsma et al), 4,591,700 (Sopory), 4,724,417 (Au et al), 4,774,024 (Deep et al), 4,935,156 (van Konynenburg et al), and 5,049,850 (Evans et al), and copending, commonly assigned application Ser. Nos. 07/788,655 (Baigrie et al), filed Nov. 6, 1991, now U.S. Pat. No. 5,250,228, issued Oct. 5, 1993, and 07/894,119 (Chandler et al), filed Jun. 5, 1992. The disclosure of each of these patents and applications is incorporated herein by reference.

Many conductive polymer compositions exhibit positive temperature coefficient of resistance (PTC) behavior, i.e. the resistance increases anomalously from a low resistance, low temperature state to a high resistance, high temperature state at a particular temperature, i.e. the switching temperature $T_s$. The ratio of the resistance at high temperature to the resistance at low temperature is the PTC anomaly height. When the composition is in the form of a circuit protection device placed in series with a load in an electrical circuit, under normal operating conditions the device has a relatively low resistance and low temperature. If, however, a fault occurs, e.g. due to excessive current in the circuit or a condition which induces excessive heat generation within the device, the device "trips", i.e. is converted to its high resistance, high temperature state. As a result, the current in the circuit is reduced and other components are protected. When the fault condition is removed, the device resets, i.e. returns to its low resistance, low temperature condition. Fault conditions may be the result of a short circuit, the introduction of additional power to the circuit, or overheating of the device by an external heat source, among other reasons. For many circuits, it is necessary that the device have a very low resistance in order to minimize the impact of the device on the total circuit resistance during normal circuit operation. As a result, it is desirable for the composition comprising the device to have a low resistivity, i.e. less than 10 ohm-cm, which allows preparation of relatively small, low resistance devices. In addition, for some applications, e.g. circuit protection of components in the engine compartment or other locations of automobiles, it is necessary that the composition be capable of withstanding ambient temperatures which are relatively high, e.g. as much as 125° C. without changing substantially in resistivity. In order to successfully withstand such exposure, it is desirable that the melting point of the composition be higher than the expected ambient temperature. Among those polymers which have relatively high melting points are crystalline fluorinated polymers.

Crystalline fluorinated polymers, also referred to herein as fluoropolymers, have been disclosed for use in conductive polymer compositions. For example, Sopory (U.S. Pat. No. 4,591,700) discloses a mixture of two crystalline fluoropolymers for use in making relatively high resistivity compositions (i.e. at least 100 ohm-cm) for self-limiting strip heaters. The melting point of the second polymer is at least 50° C. higher than that of the first fluoropolymer and the ratio of the first polymer to the second polymer is 1:3 to 3:1. Van Konynenburg et al (U.S. Pat. No. 5,093,898) discloses compositions for use in flexible strip heaters or circuit protection devices which are prepared from polyvinylidene fluorides which have a low head-to-head content (i.e. a relatively low number of units of $—CH_2CF_2——CF_2CH_2—$ compared to $—CH_2CF_2——CH_2CF_2—$). Lunk et al (U.S. Pat. No. 4,859,836) discloses a melt-shapeable composition in which a first fluoropolymer of relatively low crystallinity and a second fluoropolymer of relatively high crystallinity which is not melt-shapeable in the absence of other polymers, e.g. irradiated polytetrafluorethylene, are mixed to produce a highly crystalline material suitable for use in heaters and circuit protection devices. Chu et al (U.S. patent application Ser. No. 08/021,827, filed Feb. 24, 1993, now U.S. Pat. No. 5,317,061, issued May 31, 1994) discloses a mixture of a copolymer of tetrafluoroethylene and hexafluoropropylene (FEP), a copolymer of tetrafluoroethylene and perfluoropropylvinyl ether (PFA), and polytetrafluoroethylene to prepare a composition which has good physical properties and exhibits little stress-cracking when exposed to elevated temperatures. The disclosure of each of these patents and applications is incorporated herein by reference.

SUMMARY OF THE INVENTION

It is often difficult when preparing conductive polymer compositions to achieve compositions which exhibit both adequate low resistivity and high PTC anomaly. It is known that for a given type of particulate conductive filler, an increase in filler content will generally produce a decrease in resistance and a corresponding decrease in PTC anomaly height. In addition, very high filler loadings result in compositions which have poor physical properties and cannot be readily shaped into circuit protection devices. Furthermore, it is known that normal processing steps such as extrusion, lamination, and/or heat-treatment will increase the resistivity of a composition with a higher initial resistivity to a greater extent than for a similar, lower resistivity composition. Therefore it has been difficult to maintain a low resistivity and a high PTC anomaly.

We have now discovered that the addition of a small quantity of a second crystalline fluorinated polymer to a first crystalline fluorinated polymer will produce a conductive polymer composition which has good low resistivity, adequate PTC anomaly, and good process stability. In a first aspect, this invention discloses a conductive polymer composition which (1) has a resistivity at 20° C., $\rho_{20}$, of less than 10 ohm-cm, (2) exhibits PTC behavior, and (3) comprises (a) a polymeric component which comprises (i) at least 50% by volume based on the volume of the polymeric component of a first crystalline fluorinated polymer having a first melting point $T_{m1}$, and (ii) 1 to 20% by volume based on the volume of the polymeric component of a second crystalline fluorinated polymer having a second melting point $T_{m2}$ which is from $(T_{m1}+25)°$ C. to $(T_{m1}+100)°$ C.; and (b) dispersed in the polymeric component, a particulate conductive filler;

said composition having at least one of the following characteristics (A) a resistivity at at least one temperature in the range 20° C. to $(T_{m1}+25)°$ C. which is at least $10^4\rho_{20}$ ohm-cm, (B) said composition being such that (1) when a second composition is prepared which is the same as said composition except that it does not contain the second fluorinated polymer, the resistivity at 20° C. of the second composition is in the range $0.8\rho_{20}$ to $1.2\rho_{20}$, and (2) at a temperature $T_x$ which is in the range 20° C. to $(T_{m1}+25)°$ C. said composition has a resistivity $\rho_x$ which is at least 1.05 times greater than the resistivity at $T_x$ for the second composition, (C) said composition being such that (1) when a second composition is prepared which is the same as said composition except that it does not contain the second fluorinated polymer, the resistivity at 20° C. of the second composition is in the range $0.8\rho_{20}$ to $1.2\rho_{20}$, and (2) when formed into a first standard circuit protection device which has an initial resistance $R_0$ at 25° C. and which forms a part of a test circuit which consists essentially of the device, a switch and a source of DC electrical power having a voltage of 19 volts, and a test is conducted by (i) closing the switch and allowing the device to trip into a high temperature, high resistance stable operating condition, (ii) maintaining the device at 19 volts DC for 300 hours, (iii) opening the switch and allowing the device to cool to 25° C., (iv) measuring the resistance $R_{300}$ at 25° C., and (v) calculating the test ratio $R_{300}/R_0$, then the ratio $R_{300}/R_0$ for the said composition is at most 0.5 times the ratio $R_{300}/R_0$ for a second standard circuit protection device prepared from the second composition.

In a second aspect, this invention discloses an electrical device, e.g. a circuit protection device, which comprises (A) a conductive polymer element composed of a conductive polymer composition of the first aspect of the invention; and (B) two electrodes which are in electrical contact with the conductive polymer element and which can be connected to a source of electrical power to cause current to flow through the conductive polymer element.

DETAILED DESCRIPTION OF THE INVENTION

The conductive polymers of this invention exhibit PTC behavior. The term "PTC behavior" is used in this specification to denote a composition or an electrical device which has an $R_{14}$ value of at least 2.5 and/or an $R_{100}$ value of at least 10, and it is particularly preferred that the composition should have an $R_{30}$ value of at least 6, where $R_{14}$ is the ratio of the resistivities at the end and the beginning of a 14° C. temperature range, $R_{100}$ is the ratio of the resistivities at the end and the beginning of a 100° C. range, and $R_{30}$ is the ratio of the resistivities at the end and the beginning of a 30° C. range.

The terms "fluorinated polymer" and "fluoropolymer" are used in this specification to denote a polymer which contains at least 10% preferably at least 25%, by weight of fluorine, or a mixture of two or more such polymers.

Compositions of this invention comprise a polymeric component which comprises at least two crystalline fluorinated polymers. Both the first and the second polymers have a crystallinity of at least 10%, preferably at least 20%, particularly at least 30%, e.g. 30 to 70%. The crystallinity of the first polymer is generally greater than that of the second polymer. For example, the crystallinity of the first polymer may be 40 to 70% while the crystallinity of the second polymer is 30 to 50%.

The first crystalline fluorinated polymer is in the polymeric component at at least 50% by volume, preferably at least 55% by volume, particularly at least 60% by volume based on the volume of the polymeric component. The first polymer has a melting point $T_{m1}$. (The melting points referred to herein are the peak values of the peaks of a differential scanning calorimeter (DSC) curve.) For many applications it is preferred that the first polymer be polyvinylidene fluoride (PVDF). The PVDF is preferably a homopolymer of vinylidene fluoride, but small quantities (e.g. less than 15% by weight) of comonomers, e.g. tetrafluoroethylene, hexafluoropropylene, and ethylene, may also be present. Particularly useful is PVDF which is made by a suspension polymerization technique rather than an emulsion polymerization technique. Polymer made by such a suspension polymerization technique generally has a lower head-to-head content (e.g. less than 4.5%) than polymer made by emulsion polymerization, and usually has a higher crystallinity and/or melting temperature. Suitable suspension-polymerized PVDFs are described in van Konynenburg et al (U.S. Pat. No. 5,093,898), the disclosure of which is incorporated herein by reference.

The second crystalline fluorinated polymer in the polymeric component has a melting point $T_{m2}$ which is from $(T_{m1}+25)°$ C. to $(T_{m1}+100)°$ C., preferably from $(T_{m1}+25)°$ C. to $(T_{m1}+80)°$ C., particularly from $(T_{m1}+25)°$ C. to $(T_{m1}+70)°$ C. It is present in the composition from 1 to 20% by volume, preferably 2 to 20% by volume, particularly 4 to 18% by volume based on the volume of the polymeric component. For many applications, and especially when the first polymer is PVDF, it is preferred that the second polymer be a copolymer of ethylene and tetrafluoroethylene (ETFE) or a terpolymer of ethylene, tetrafluoroethylene, and a third monomer, which may be, for example, perfluorinated-butyl ethylene. Where the term "ETFE" is used in this specification, it is to be understood to include other polymers, e.g. terpolymers, in which the primary monomers are ethylene and tetrafluoroethylene, and a third monomer is present in a small amount, e.g. less than 5% by weight of the polymer.

In addition to the first and second polymers, the composition may comprise one or more additional polymers to improve the physical properties or the electrical stability of the composition. Such additional polymers, e.g. elastomers or other crystalline polymers, are generally present at less than 30% by volume, preferably less than 25% by volume, based on the volume of the polymeric component.

In addition to the polymeric component, compositions of this invention also comprise a particulate conductive filler which is dispersed in the polymeric component. This filler may be, for example, carbon black, graphite, metal, metal oxide, conductive coated glass or ceramic beads, particulate conductive polymer, or a combination of these. The filler may be in the form of powder, beads, flakes, fibers, or any other suitable shape. The quantity of conductive filler needed is based on the required resistivity of the composition and the resistivity of the conductive filler itself. For many compositions the conductive filler comprises 10 to 60% by volume, preferably 20 to 50% by volume, especially 25 to 45% by volume of the total volume of the composition.

The conductive polymer composition may comprise additional components, such as antioxidants, inert fillers, nonconductive fillers, radiation crosslinking agents (often referred to as prorads or crosslinking enhancers), stabilizers, dispersing agents, coupling agents, acid scavengers (e.g. $CaCO_3$), or other components.

The components of the composition may be mixed using any appropriate technique including melt-processing by use of an internal mixer or extruder, solvent-mixing, and dispersion blending. For some compositions it is preferred to preblend the dry components prior to mixing. Following mixing the composition can be melt-shaped by any suitable method to produce devices. Thus, the compound may be melt-extruded, injection-molded, compression-molded, or sintered. Depending on the intended end-use, the composition may undergo various processing techniques, e.g. crosslinking or heat-treatment, following shaping. Crosslinking can be accomplished by chemical means or by irradiation, e.g. using an electron beam or a $Co^{60}$ $\gamma$ irradiation source.

The compositions of the invention have a resistivity at 20° C., $\rho_{20}$, of less than 10 ohm-cm, preferably less than 7 ohm-cm, particularly less than 5 ohm-cm, especially less than 3 ohm-cm, e.g. 0.05 to 2 ohm-cm.

Compositions of the invention have one or more of a number of characteristics. First, when the composition switches into a high resistance, high temperature condition, the resistivity increases by at least a factor of $10^4$ from $\rho_{20}$. Therefore, the resistivity at at least one temperature in the range 20° C. to $(T_{m1}+25)$° C. is at least $10^4\rho_{20}$, preferably at least $10^{4.1}\rho_{20}$, particularly at least $10^{4.2}\rho_{20}$. This increase may be reported in "decades" of PTC anomaly. Thus if the PTC anomaly in decades is given as x, this means that the resistivity at a designated temperature was $10^x$ times the resistivity at 20° C.

A second possible characteristic reflects the improvement in PTC anomaly height for a composition of the invention over a second composition which is the same as the conductive polymer composition of the invention except that it does not comprise the second fluorinated polymer. In addition, the second composition has a resistivity at 20° C. which is within 20% of the resistivity at 20° C. of the conductive polymer composition of the invention, i.e. in the range $0.8\rho_{20}$ to $1.2\rho_{20}$. At a temperature $T_x$ which is in the range 20° C. to $(T_{m1}+25)$° C., the composition of the invention has a resistivity which is at least 1.05 times greater, preferably 1.10 times greater, particularly at least 1.15 times greater than the resistivity at $T_x$ for the second composition.

A third possible characteristic reflects the improvement in resistivity stability of compositions of the invention when in the high temperature, high resistivity state. The composition is formed into a first standard circuit protection device and is then tested. In this application, a "standard circuit protection device" is defined as a device which is prepared by first extruding a sheet of conductive polymer composition with a thickness of 0.25 mm, then laminating electrodeposited nickel-coated copper electrodes onto the extruded sheet by compression-molding, irradiating the laminate to 10 Mrads, cutting a piece with dimensions of $11\times15\times0.25$ mm from the sheet, attaching steel plates with dimensions of $11\times15\times0.51$ mm to the metal foil on each side of the device by soldering, and then temperature cycling the device from 40° C. to 135° C. and back to 40° C. at a rate of 10° C./minute six times, holding the devices at 40° C. and 135° C. for 30 minutes on each of the six cycles. The initial resistance of the device $R_0$ is measured at 25° C. and the device is inserted into a test circuit which consists essentially of the device, a switch, and a 19 volt DC power supply. The switch is closed and the device is allowed to trip into its high temperature, high resistance operating condition and is maintained for 300 hours. At the end of 300 hours, the power is removed, the device is allowed to cool to 25° C. and the resistance $R_{300}$ at 25° C. is measured. The test ratio $R_{300}/R_0$ is calculated. This ratio is at most 0.5 times, preferably at most 0.45 times, particularly at most 0.4 times the ratio $R_{300}/R_0$ for a similar device prepared from the second composition, described above, which does not comprise the second fluorinated polymer.

The compositions of the invention can be used to prepare electrical devices, e.g. circuit protection devices, heaters, or resistors. Compositions of the invention are particularly suitable for use in circuit protection devices. Such devices comprise a conductive polymer element which is composed of the composition of the invention and which can have any suitable shape. Attached to the polymer element are at least two electrodes which are in electrical contact with the element and which can be connected to a source of electrical power to cause current to flow through the element. Although the circuit protection devices can have any shape, e.g. planar or dogbone, particularly useful circuit protection devices of the invention comprise two laminar electrodes, preferably metal foil electrodes, and a conductive polymer element sandwiched between them. Particularly suitable foil electrodes are disclosed in U.S. Pat. Nos. 4,689,475 (Matthiesen) and 4,800,253 (Kleiner et al), the disclosure of each of which is incorporated herein by reference. Additional metal leads, e.g. in the form of wires, can be attached to the foil electrodes to allow electrical connection to a circuit. In addition, elements to control the thermal output of the device, i.e. one or more conductive terminals can be used. These terminals can be in the form of metal plates, e.g. steel, copper, or brass, or fins, which are attached either directly or by means of an intermediate layer such as solder or a conductive adhesive, to the electrodes. See, for example, U.S. Pat. No. 5,089,801 (Chan et al), and U.S. application No. 07/837,527 (Chan et al), filed Feb. 18, 1992, now abandoned in favor of continuation application, No. 08/087,017, filed Jul. 6, 1993. For some applications, it is preferred to attach the devices directly a circuit board. Examples of such attachment techniques are shown in U.S. application Ser. No. 07/910,950 (Graves et al), filed Jul. 9, 1992. Other examples of devices for which compositions of the invention are suitable are found in U.S. Pat. Nos. 4,238,812 (Middleman et al), 4,255,798 (Simon), 4,272,471 (Walker), 4,315,237 (Middleman et al), 4,317,027 (Middleman et al), 4,330,703 (Horsma et al), 4,426,633 (Taylor), 4,475,138 (Middleman et al), 4,742,417 (Au et al), 4,780,598 (Fahey et al), 4,845,838 (Jacobs et al), 4,907,340 (Fang et al), and 4,924,074 (Fang et al). The disclosure of each of these patents and applications is incorporated herein by reference.

Circuit protection devices of the invention generally have a resistance of less than 100 ohms, preferably less than 50 ohms, particularly less than 30 ohms, especially less than 20 ohms, most especially less than 10 ohms. For many applications, the resistance of the device is less than 1 ohm.

The invention is illustrated by the following examples.

EXAMPLES 1 TO 7

Using the ratios indicated in Table I, polyvinylidene fluoride (PVDF) powder, ethylene/tetrafluoroethylene copolymer (ETFE) powder, and carbon black powder were dry blended and then mixed for 16 minutes in a Brabender TM mixer heated to 260° C. The material was compression-molded to form a plaque with a thickness of about 0.51 mm (0.020 inch). Each plaque was laminated on two sides with electrodeposited nickel foil (available from Fukuda) having a thickness of about 0.033 mm (0.0013 inch). The resulting laminate had a thickness of 0.51 to 0.64 mm (0.020 to 0.025 inch). The laminate was irradiated to 10 Mrads using a 3.0 MeV electron beam, and devices with a diameter of 12.7 mm (0.5 inch) were punched from the irradiated laminate. Each device was soldered to 20 AWG tin-coated copper leads by using a solder bath heated to approximately 300° C.

The resistance of the devices was measured using a 4-wire measurement technique, and the resistivity was calculated. As shown in Table I, at a constant carbon black loading, the resistivity decreased with increasing ETFE content. The resistance as a function of temperature for the devices was determined by inserting the devices into an oven, increasing the temperature from 20° C. to 200° C. and back to 20° C. for two cycles, and, at temperature intervals, measuring the resistance at 10 volts DC. The reported values are those measured on the second heating cycle. The height of the PTC anomaly was determined by calculating the ratio of the resistance at 180° C. to the resistance at 20° C. The results, in decades of PTC anomaly, are shown in Table I, and indicate that the PTC anomaly height decreased with increasing ETFE content. Thus if the PTC anomaly is given as x, this means that the resistance at 180° C. was $10^x$ times the resistance at 20° C. Using a thermal mechanical analyzer (TMA), the expansion of the devices was measured at 200° C. The results, shown in Table I, indicated that the expansion decreased with increasing ETFE content.

TABLE I

| COMPONENT (Volume %) | EXAMPLE 1 | 2 | 3 | 4 | 5 | 6 | 7 |
|---|---|---|---|---|---|---|---|
| PVDF | 60 | 54 | 50 | 40 | 30 | 15 | 0 |
| ETFE | 0 | 6 | 10 | 20 | 30 | 45 | 60 |
| CB | 40 | 40 | 40 | 40 | 40 | 40 | 40 |
| Resistivity at 20° C. (ohm-cm) | 1.7 | 1.3 | 1.0 | 0.7 | 0.9* | 0.4 | 0.4 |
| PTC Anomaly (decades) | 5.1 | 4.9 | 3.3 | 1.7 | 1.0 | 0.6 | 0.4 |

TABLE I-continued

| COMPONENT (Volume %) | EXAMPLE 1 | 2 | 3 | 4 | 5 | 6 | 7 |
|---|---|---|---|---|---|---|---|
| % Expansion | 6.0 | 6.3 | 5.9 | 4.6 | 4.1 | 4.6 | 3.5 |

Notes to Table I:

PVDF is KF TM 1000, polyvinylidene fluoride powder available from Kureha, which is made by a suspension-polymerization technique and has a peak melting point as measured by DSC of about 175° C., and a crystallinity of about 55 to 60%.

ETFE is Tefzel TM HT2163 (formerly Tefzel TM 2129-P), ethylene/tetrafluoroethylene/perfluorinated butyl ethylene terpolymer powder available from DuPont, which has a peak melting point of about 235° C., and a crystallinity of about 40 to 45° C. %.

CB is Raven TM 430 powder, carbon black available from Columbian Chemicals, which has a particle size of about 82 millimicrons, a surface area of about 35 $m^2/g$, and DBP number of about 83 cc/100 g.

*The compositions of Example 5 exhibited some delamination of the metal foil electrodes, resulting in an anomalously high resistivity.

EXAMPLES 8 TO 12

Following the procedure of Examples 1 to 7, devices were prepared from compositions having a resistivity at 20° C. of about 1 ohm-cm. The PTC anomaly was highest for the composition which contained 6% ETFE (Example 10). The results are shown in Table II.

TABLE II

| COMPONENT (Volume %) | Example 8 | 9 | 10 | 11 | 12 |
|---|---|---|---|---|---|
| PVDF | 58 | 55.3 | 54 | 52.7 | 42 |
| ETFE | 0 | 4 | 6 | 8 | 20 |
| CB | 42 | 40.7 | 40 | 39.3 | 38 |
| Resistivity at 20° C. (ohm-cm) | 1.20 | 0.93 | 0.94 | 1.0 | 0.95 |
| PTC Anomaly (decades) | 3.0 | 3.4 | 4.1 | 4.0 | 2.1 |

EXAMPLES 13 TO 16

The ingredients listed in Table III were dry-blended in a Henschel mixer, mixed in a co-rotating twin screw extruder heated to about 210° to 250° C., extruded into a strand, and pelletized. The pellets were extruded to form a sheet with a thickness of about 0.5 mm (0.020 inch). The sheet was cut into pieces with dimensions of 0.30×0.41 m (12×16 inch). Two sheets were stacked together and electrodeposited nickel-coated copper foil (N2PO, available from Gould) was laminated onto two sides to give a laminate with a thickness of about 1.0 mm (0.040 inch). The laminate was irradiated as above, and devices with dimensions of 10×10 mm (0.40×0.40 inch) were cut and attached to 24 AWG wire leads by solder dipping at 250° C. for 2 to 3 seconds. The devices were then temperature cycled from 40° C. to 135° C. and back to 40° C. at a rate of 10° C./minute six times. The dwell time at 40° C. and 135° C. was 30 minutes for each cycle. The response of the compositions to processing was determined by comparing the resistivity of a sample cut from the laminate prior to irradiation, lead attach, or temperature cycling (i.e. $\rho_1$) with a finished device after the final temperature cycling (i.e. $\rho_4$). The results, as shown in Table III, indicated that the formulations which contained 6 to 10 volume % ETFE were the most stable and had the smallest increase in resistivity (based on percent) during processing.

TABLE III

| COMPONENT (Volume %) | Example 13 | 14 | 15 | 16 |
|---|---|---|---|---|
| PVDF | 60.1 | 56.7 | 54.1 | 50.1 |
| ETFE | 0 | 6.1 | 6.0 | 10.0 |
| CB | 35.5 | 35.9 | 35.5 | 35.5 |
| $CaCO_3$ | 1.3 | 1.3 | 1.3 | 1.3 |

TABLE III-continued

| COMPONENT (Volume %) | Example 13 | 14 | 15 | 16 |
|---|---|---|---|---|
| TAIC | 3.1 | 0 | 3.1 | 3.1 |
| $\rho_1$ (ohm-cm) | 0.87 | 1.23 | 0.81 | 0.70 |
| $\rho_4$ (ohm-cm) | 1.40 | 1.36 | 1.13 | 0.80 |
| $\rho_4/\rho_1$ | 1.61 | 1.11 | 1.40 | 1.15 |

Notes to Table III:
PVDF is KF TM 1000, as described in Table I.
ETFE is Tefzel TM HT2163, as described in Table I.
CB is Raven TM 430 carbon black in the form of beads with properties as described in Table I.
$CaCO_3$ is Atomite TM powder, calcium carbonate available from John K. Bice Co.
TAIC is triallyl isocyanurate, a crosslinking enhancer.

EXAMPLES 17 TO 19

Following the procedure of Examples 13 to 16 and using the same ingredients, the compositions of Table IV were mixed, extruded, laminated, irradiated to 10 Mrad, and cut into devices with dimensions of 11×15×0.25 mm (0.43×0.59×0.010 inch). Steel plates (11×15×0.51 mm; 0.43×0.59.0.020 inch) were soldered to the metal foil on both sides of each device. The devices were then temperature cycled. The resistance of each device was measured at 25° C. ($R_0$). The devices were then powered slowly to cause them to trip into the high resistance state. They were then maintained at 19 volts DC with no additional resistance in the circuit. At 24 and 300 hour intervals, the power was removed from the devices, the devices were cooled for 1 hour at room temperature, and the resistance was measured ($R_{24}$ and $R_{300}$, respectively). As shown in Table IV, those devices containing ETFE had improved stability as determined by $R_{24}/R_0$ and $R_{300}/R_0$.

TABLE IV

| Component (Volume %) | Example 17 | 18 | 19 |
|---|---|---|---|
| PVDF | 60.1 | 56.7 | 54.1 |
| ETFE | 0 | 6.1 | 6.0 |
| CB | 35.5 | 35.9 | 35.5 |
| $CaCO_3$ | 1.3 | 1.3 | 1.3 |
| TAIC | 3.1 | 0 | 3.1 |
| $R_0$ (mohms) | 20.2 | 21.5 | 17.3 |
| $R_{24}/R_0$ | 5.96 | 2.49 | 2.56 |
| $R_{300}/R_0$ | 14.4 | 5.22 | 6.89 |
| PTC anomaly (decades) | 4.2 | 6.0 | 4.5 |

EXAMPLES 20 TO 27

Following the procedure of Examples 1 to 7, devices were prepared using the ingredients shown in Table V. The highest PTC anomaly was found for the compounds in which the difference in melting temperature between the PVDF and the ETFE was less than 100° C.

TABLE V

| Component (Volume %) | $T_m$ (°C.) | EXAMPLE 20 | 21 | 22 | 23 | 24 | 25 | 27 | 26 |
|---|---|---|---|---|---|---|---|---|---|
| PVDF | 175 | 60 | 54 | 54 | 50 | 54 | 50 | 54 | 50 |
| ETFE 1 | 220 | | 6 | | | | | | |
| ETFE 2 | 235 | | | 6 | 10 | | | | |
| ETFE 3 | 245 | | | | | 6 | 10 | | |
| ETFE 4 | 275 | | | | | | | 6 | 10 |
| CB | | 40 | 40 | 40 | 40 | 40 | 40 | 40 | 40 |
| Resistivity at 20° C. (ohm-cm) | | 1.2 | 0.71 | 0.8 | 0.9 | 0.8 | 0.85 | 0.95 | 0.87 |
| PTC Anomaly (decades) | | 4.1 | 4.0 | 4.8 | 4.3 | 3.5 | 3.1 | 2.3 | 2.7 |

Notes to Table V:
PVDF is KF TM 1000, as described in Table I.
ETFE 1 is Neoflon EP-620, ethylene/tetrafluoroethylene copolymer available from Daikin which has a peak melting point of about 220° C.
ETFE 2 is Tefzel TM HT2163, as described in Table I.
ETFE 3 is Tefzel TM HT2162, ethylene/tetrafluoroethylene copolymer available from DuPont which has a peak melting point of about 245° C.
ETFE 4 is Tefzel TM 2158, ethylene/tetrafluoroethylene copolymer available from DuPont which has a peak melting point of about 275° C.
CB is Raven TM 430 powder as described in Table I.

EXAMPLES 28 TO 30

Following the procedure of Examples 1 to 7, the ingredients listed in Table VI were mixed, compression-molded into a sheet with a thickness of about 0.51 mm (0.020 inch), laminated with nickel foil and irradiated to 10 Mrad. Circular devices having a diameter of 12.3 mm (0.5 inch) were cut from the laminate and 20 AWG wire leads were attached. Following temperature cycling as in Examples 13 to 16, the values for device resistivity, PTC anomaly height, $R_0$ (initial resistance), and $R_{24}$ (resistance after 24 hours powered into a high resistance state as described in Examples 13 to 16) were determined. The results are shown in Table VI. It is apparent that, in contrast to Examples 8 to 12, the addition of the ETFE does not enhance the PTC anomaly height for Examples 28 to 30 which contain emulsion polymerized PVDF.

TABLE VI

| Component (Volume %) | EXAMPLE 28 | 29 | 30 |
|---|---|---|---|
| PVDF | 60.5 | 54.5 | 50.5 |
| ETFE | | 6.0 | 10.0 |
| CB | 39.5 | 39.5 | 39.5 |
| Resistivity at 20° C. (ohm-cm) | 1.65 | 1.1 | 0.84 |
| PTC anomaly (decades) | 3.5 | 2.5 | 1.8 |
| $R_0$ (mohms) | 49.7 | 33.4 | 32.3 |
| $R_{24}$ | 87.8 | 204.1 | 548.3 |
| $R_{24}/R_0$ | 1.77 | 6.11 | 16.97 |

Notes to Table VI:
PVDF is Kynar TM 451, polyvinylidene fluoride available from Pennwalt which has a peak melting point of about 165° C. and is made by an emulsion polymerization technique.
ETFE is Tefzel TM HT2163, as described in Table I.
CB is Raven TM 430 powder as described in Table I.

What is claimed is:

1. A conductive polymer composition which
(1) has a resistivity at 20° C. , $\rho_{20}$, of less than 10 ohm-cm,
(2) exhibits PTC behavior, and
(3) comprises
(a) a polymeric component which comprises (i) at least 50% by volume based on the volume of the polymeric component of a first crystalline fluorinated polymer which is polyvinylidene fluoride and which has a first melting point $T_{m1}$, and (ii) 1 to 20% by volume based on the volume of the polymeric component of a second crystalline fluorinated polymer which is an ethylene/tetrafluoroethylene copolymer or a terpolymer of ethylene, tetrafluoroethylene, and a third monomer and which has a second melting point $T_{m2}$ which is from ($T_{m1}$+25)° C. to ($T_{m1}$+100)° C.; and (b) dispersed in the polymeric component, a particulate conductive filler;

said composition having at least one of the following characteristics (A) a resistivity at at least one temperature in the range 20° C. to $(T_{m1}+25)$° C. which is at least $10^4\rho_{20}$ ohm-cm, (B) said composition being such that (1) when a second composition is prepared which is the same as said composition except that it does not contain the second fluorinated polymer, the resistivity at 20° C. of the second composition is in the range $0.8\rho_{20}$ to $1.2\rho_{20}$, and (2) at a temperature $T_x$ which is in the range 20° C. to $(T_{m1}+25)$° C., said composition has a resistivity $\rho_x$ which is at least 1.05 times greater than the resistivity at $T_x$ for the second composition, (C) said composition being such that (1) when a second composition is prepared which is the same as said composition except that it does not contain the second fluorinated polymer, the resistivity at 20° C. of the second composition is in the range $0.8\rho_{20}$ to $1.2\rho_{20}$, and (2) when formed into a first standard circuit protection device which has an initial resistance $R_0$ at 25° C. and which forms a part of a test circuit which consists essentially of the device, a switch and a source of DC electrical power having a voltage of 19 volts, and a test is conducted by (i) closing the switch and allowing the device to trip into a high temperature, high resistance stable operating condition, (ii) maintaining the device at 19 volts DC for 300 hours, (iii) opening the switch and allowing the device to cool to 25° C., (iv) measuring the resistance $R_{300}$ at 25° C., and (v) calculating the test ratio $R_{300}/R_0$, then the ratio $R_{300}/R_0$ for the said composition is at most 0.5 times the ratio $R_{300}/R_0$ for a second standard circuit protection device prepared from the second composition.

2. A composition according to claim 1 wherein the polyvinylidene fluoride has been made by suspension polymerization.

3. A composition according to claim 1 wherein the polyvinylidene fluoride has a head-to-head content of less than 4.5%.

4. A composition according to claim 1 wherein the particulate conductive filler comprises 10 to 60% by volume of the total volume of the composition.

5. A composition according to claim 1 wherein the particulate filler comprises carbon black.

6. A composition according to claim 1 wherein the particulate filler comprises metal.

7. A composition according to claim 1 wherein $\rho_{20}$ is less than 7 ohm-cm.

8. A composition according to claim 1 wherein the polymeric component comprises 2 to 20% by volume of the second polymer.

9. An electrical device which comprises (A) a conductive polymer element composed of a conductive polymer composition which (1) has a resistivity at 20° C., $\rho_{20}$, of less than 10 ohm-cm, (2) exhibits PTC behavior, and (3) comprises (a) a polymeric component which comprises (i) at least 50% by volume based on the volume of the polymeric component of a first crystalline fluorinated polymer which is polyvinylidene fluoride and which has a first melting point $T_{m1}$, and (ii) 1 to 20% by volume based on the volume of the polymeric component of a second crystalline fluorinated polymer which is an ethylene/tetrafluoroethylene copolymer or a terpolymer of ethylene, tetrafluoroethylene, and a third monomer and which has a second melting point $T_{m2}$ which is from $(T_{m1}+25)$° C. to $(T_{m1}+100)$° C.; and (b) dispersed in the polymeric component, a particulate conductive filler;

said composition having at least one of the following characteristics (1) a resistivity at at least one temperature in the range 20° C. to $(T_{m1}+25)$° C. which is at least $10^4\rho_{20}$ ohm-cm, (2) said composition being such that (a) when a second composition is prepared which is the same as said composition except that it does not contain the second fluorinated polymer, the resistivity at 20° C. of the second composition is in the range $0.8\rho_{20}$ to $1.2\rho_{20}$, and (b) at a temperature $T_x$ which is in the range 20° C. to $(T_{m1}+25)$° C., said composition has a resistivity $\rho_x$ which is at least 1.05 times greater than the resistivity at $T_x$ for the second composition, (3) said composition being such that (a) when a second composition is prepared which is the same as said composition except that it does not contain the second fluorinated polymer, the resistivity at 20° C. of the second composition is in the range $0.8\rho_{20}$ to $1.2\rho_{20}$, and (b) when formed into a first standard circuit protection device which has an initial resistance $R_0$ at 25° C. and which forms a part of a test circuit which consists essentially of the device, a switch and a source of DC electrical power having a voltage of 19 volts, and a test is conducted by (i) closing the switch and allowing the device to trip into a high temperature, high resistance stable operating condition, (ii) maintaining the device at 19 volts DC for 300 hours, (iii) opening the switch and allowing the device to cool to 25° C., (iv) measuring the resistance $R_{300}$ at 25° C., and (v) calculating the test ratio $R_{300}/R_0$, then the ratio $R_{300}/R_0$ for the said composition is at most 0.5 times the ratio $R_{300}/R_0$ for a second standard circuit protection device prepared from the second composition, and (B) two electrodes which are in electrical contact with the conductive polymer element and which can be connected to a source of electrical power to cause current to flow through the conductive polymer element.

10. A device according to claim 9 which has a resistance of less than 50 ohms.

11. A device according to claim 9 wherein the particulate filler is carbon black.

12. A device according to claim 9 wherein the electrodes are metal foils.

13. A device according to claim 11 which further includes at least one conductive terminal which is in contact with an electrode.

14. A device according to claim 11 which further includes two conductive terminals, each of which is in contact with an electrode.

15. A device according to claim 9 wherein the polyvinylidene fluoride has been made by suspension polymerization.

16. A device according to claim 9 wherein $\rho_{20}$ is less than 7 ohm-cm.

* * * * *

UNITED STATES PATENT AND TRADEMARK OFFICE

CERTIFICATE OF CORRECTION

PATENT NO. : 5,451,919

DATED : Sep. 19, 1995

INVENTOR(S) : Chu, Edward F., et al

It is certified that error appears in the above-indentified patent and that said Letters Patent is hereby corrected as shown below:

Column 6, line 64, after "directly", insert --to--.

Column 9, line 22, replace "0.43 X 0.59.0.020" by --0.43 X 0.59 X 0.020--.

Column 10, line 30, after "12" insert --which contained suspension polymerized PVDF--.

Column 12,
Claim 13, line 1, replace "11" by --9--.

Column 12,
Claim 14, line 1, replace "11" by --13--.

Signed and Sealed this

Twenty-sixth Day of March, 1996

Bruce Lehman

*Attest:*

BRUCE LEHMAN

*Attesting Officer*

*Commissioner of Patents and Trademarks*